US005938476A

United States Patent [19]

Wu et al.

[11] Patent Number: 5,938,476

[45] Date of Patent: Aug. 17, 1999

[54] CABLE CONNECTOR ASSEMBLY

[75] Inventors: Kun-Tsan Wu, Tu-Chen; Charles Chou, Chung-Ho, both of Taiwan

[73] Assignee: Hon Hai Precision Ind. Co., Ltd., Taipei Hsien, Taiwan

[21] Appl. No.: 08/845,936

[22] Filed: Apr. 29, 1997

[51] Int. Cl.[6] ..... H01R 9/03

[52] U.S. Cl. ..... 439/610

[58] Field of Search ..... 439/607–610, 439/936

[56] References Cited

U.S. PATENT DOCUMENTS

| | | | |
|---|---|---|---|
| 5,267,882 | 12/1993 | Davis | 439/610 |
| 5,456,618 | 10/1995 | Nakamura | 439/610 |
| 5,658,170 | 8/1997 | Tan et al. | 439/610 |

*Primary Examiner*—Gary Paumen

[57] ABSTRACT

A cable connector assembly comprises a plug section, and a cable end section. The plug section includes an insulating, a number of conductive contacts received in the insulating housing, and a metal shell surrounding the plug section. The insulating housing comprises a front engaging portion, a middle main body having passageways defined therethrough, and a rear supporting portion. The conductive contacts are received in the passageways and each extends at one end into the engaging portion and at the other end into the supporting portion connected to the cable end section. The main body includes a pair of blocks stopped by edges of the metal shell and a number of protrusions, on its surface, received in a number of openings on the metal shell. The metal shell comprises a number of inward bulges on a surface in interference fit with the insulating housing, a pair of beam portion extending from its rear corners, and a pair of indents on its surface. A protective layer is applied onto and a jacket is molded over a rear portion of the plug section and a front portion of the cable end section, respectively. A copper foil is provided within the jacket and over the protective layer.

6 Claims, 5 Drawing Sheets

CABLE CONNECTOR ASSEMBLY

BACKGROUND OF THE INVENTION

1. Field of The Invention

The invention relates to a cable connector assembly, particularly to a cable connector assembly for a Universal Serial Bus (USB) connector.

2. The Prior Art

There is a trend in the computer field to use USB connectors in place of most of the I/O connectors, such as D-Sub connectors and Mini-Dins. Several USB connectors designed in accordance with the Universal Serial Bus Specification Revision 1.0 have been disclosed in U.S. Patent application Ser. No. 08/533,794 and Taiwan Patent Applications Nos. 84218007 and 84113371. These connectors, however, have the shortcoming that their plug section may deform or even fracture when an external force exerts on it.

Hence, there is a need for a cable connector assembly having a structure strong enough to eliminate the above-mentioned defect of the current connectors.

SUMMARY OF THE INVENTION

Accordingly, one object of the present invention is to provide a cable connector assembly which has a structure strong enough to sustain large external forces.

Another object of the present invention is to provide a cable connector assembly which provides good shielding and grounding effects.

To fulfill the above-mentioned objects, according to one embodiment of the present invention, a cable connector assembly comprises a plug section including an insulating housing, at least one conductive contact received in at least one passageway defined through the insulating housing, and a metal shell surrounding the insulating housing; and a cable end section connected to the at least one contact for transferring electronic signals or electrical power. A protective layer is applied onto a rear portion of the plug section and a front portion of the cable end section for securely fastening these two sections. A jacket is molded over a rear portion of the plug section and a front portion of the cable end section to provide a strong structure for protecting these two sections. A copper foil is provided within the jacket for preventing external electro-magnetic interference and for grounding. Also, the cable connector assembly comprises at least one indent provided on a surface of the metal shell for positioning a mating receptacle connector. The cable end section comprises at least one wire therein having at least one conductor in electrical connection with an end of the at least one contact.

In another embodiment, the insulating housing of the plug section of the cable connector assembly comprises a front portion for engaging with a mating receptacle connector, a rear portion for supporting a connecting portion of the plug section and the cable end section, and a main body between the front engaging portion and the rear supporting portion having at least one block for positioning the insulating housing with respect to the metal shell. At least one protrusion is provided on a surface of the main body in engagement with the metal shell for increasing connecting strength between the insulating housing and the metal shell. At least one opening is provided on a surface of the metal shell for retainably receiving the at least one protrusion of the main body.

In still another embodiment, the cable connector assembly comprises at least one inward bulge provided on a surface of the metal shell in interference fit with the insulating housing. At least one beam portion extends from a rear, bottom corner of the metal shell for protecting the insulating housing and increasing the strength of the cable connector assembly.

DETAILED DESCRIPTION OF THE PREFERRED EMBODIMENTS

Figure 1:
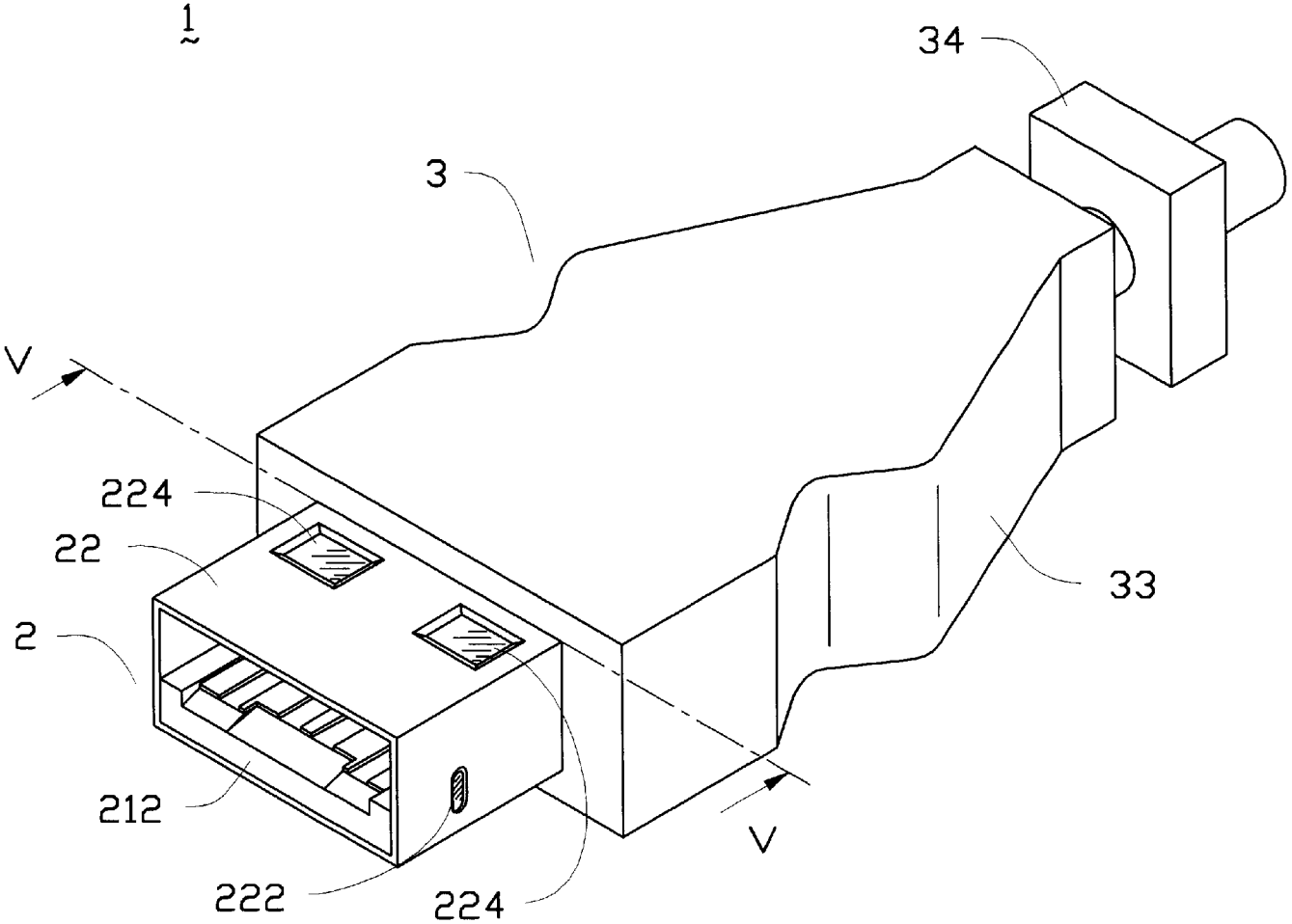
FIG. 1 is a perspective view of cable a connector assembly for a USB connector according to the present invention.
Figure 2:
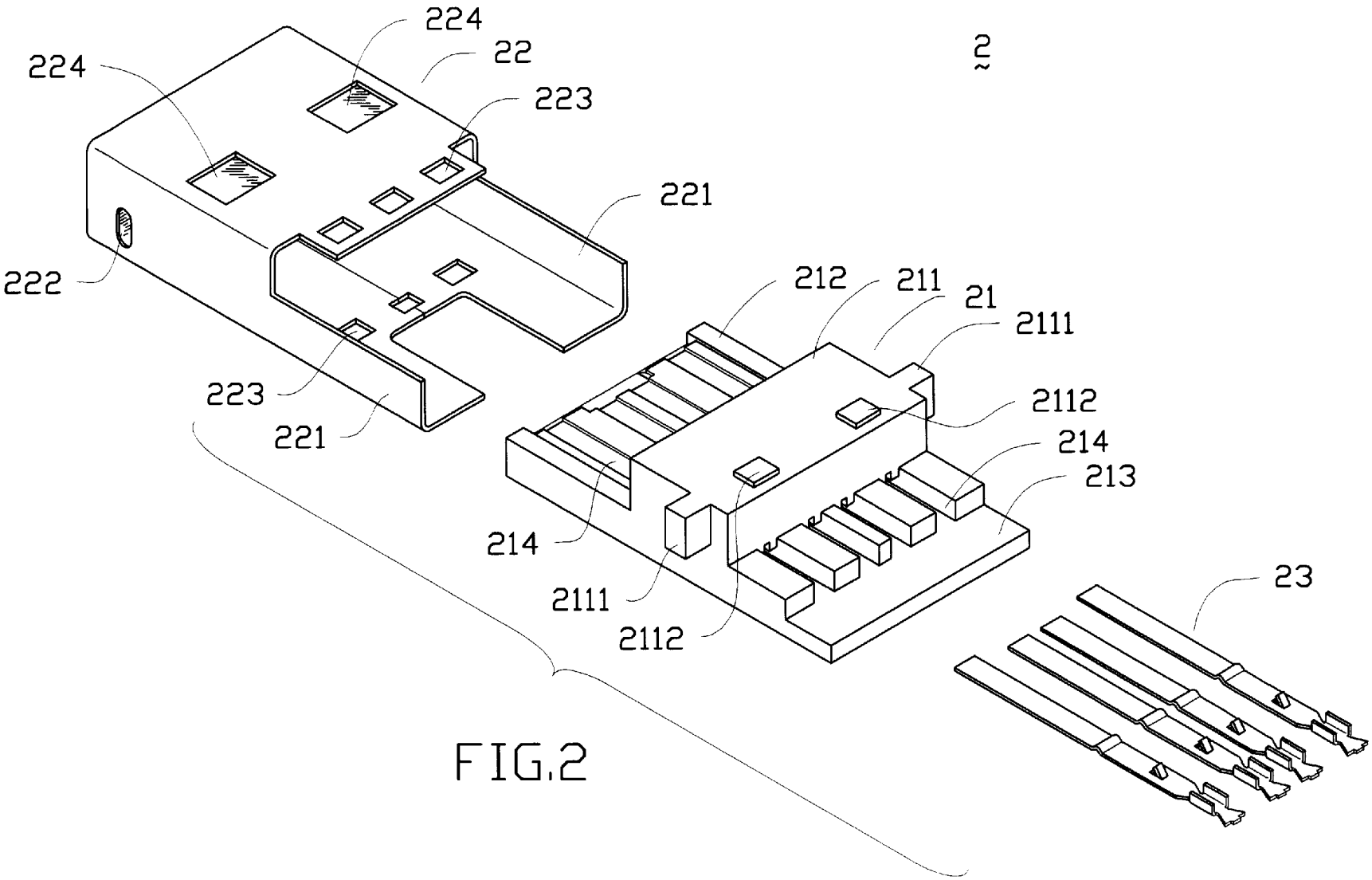
FIG. 2 is an exploded perspective view of a plug section of the connector assembly shown in FIG. 1.
Figure 3:
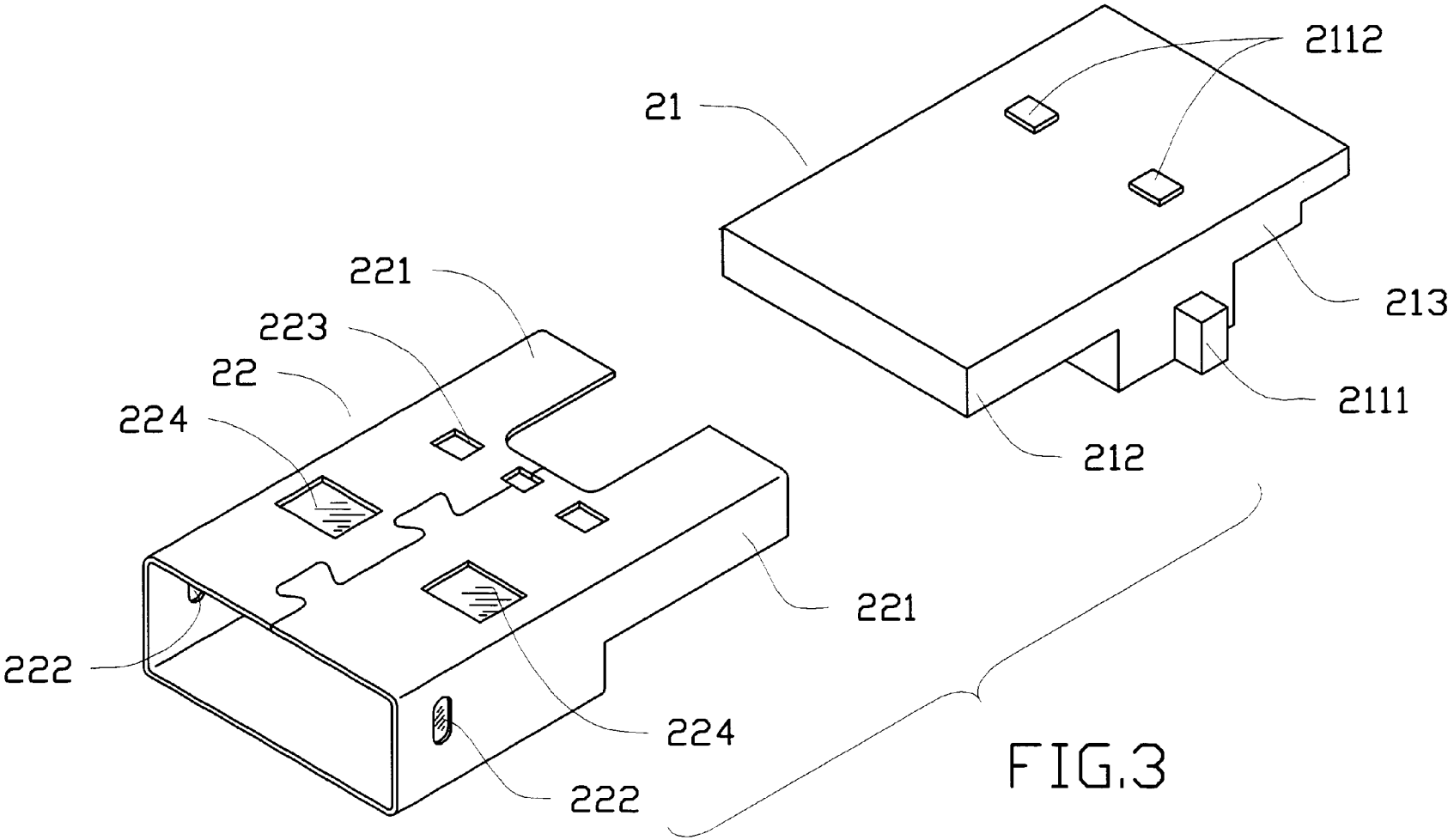
FIG. 3 is an exploded perspective view of an insulating housing and a metal shell of the plug section shown in FIG. 2 viewing from a bottom side.

Referring now to FIG. 1, a cable connector assembly for a USB connector according to the present invention is generally designated at 1. The cable connector assembly 1 comprises a plug section 2 and a cable end section 3. Also referring to FIG. 2, the plug section 2 includes an insulating housing 21, a metal shell 22, and a number of contacts 23. The insulating housing 21 comprises a main body 211, an engaging portion 212 extending forward from the main body 211, and a supporting portion 213 extending rearward from the main body 211. The insulating housing 21 comprises a number of passageways 214 extending through the main body 211 and communicating between the engaging portion 212 and the supporting portion 213. It is appreciated that the number of the contacts 23 and the corresponding passageways 214 may be changed, depending on particular applications of the cable connector assembling. For example, there may be only one contact 23 and one passageway 214. The main body 211 may further comprise at least one block 2111 on one side thereof for positioning the insulting housing 21 with respect to the metal shell 22 while the former is inserting into the latter. Moreover, the main body 211 may further comprise at least one protrusion 2112 at each of the upper and the lower surfaces of the main body 211. Similarly, the real number of the block 2111 and the protrusion 2112 may be changed; in the present embodiment, a pair of blocks 2111 are provided on the lateral surfaces of the main body 211 and a pair of protrusions 2112 are provided on each of the upper and the lower surfaces of the main body 211, as can be seen in FIGS. 2 and 3.

Figure 4:
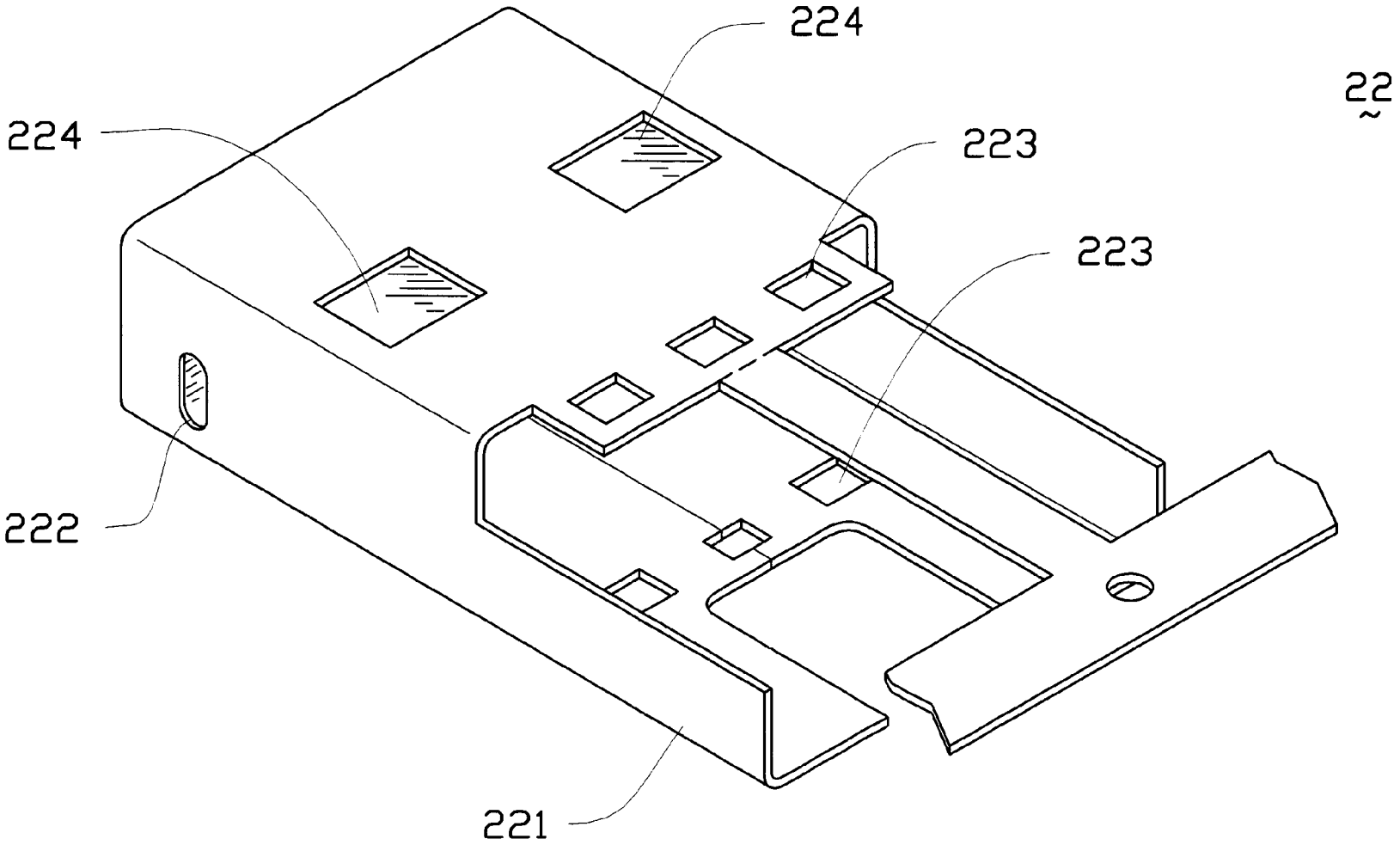
FIG. 4 is a perspective view of the metal shell shown in FIG. 2, wherein the metal shell is still connecting to a carrier.
Figure 5:
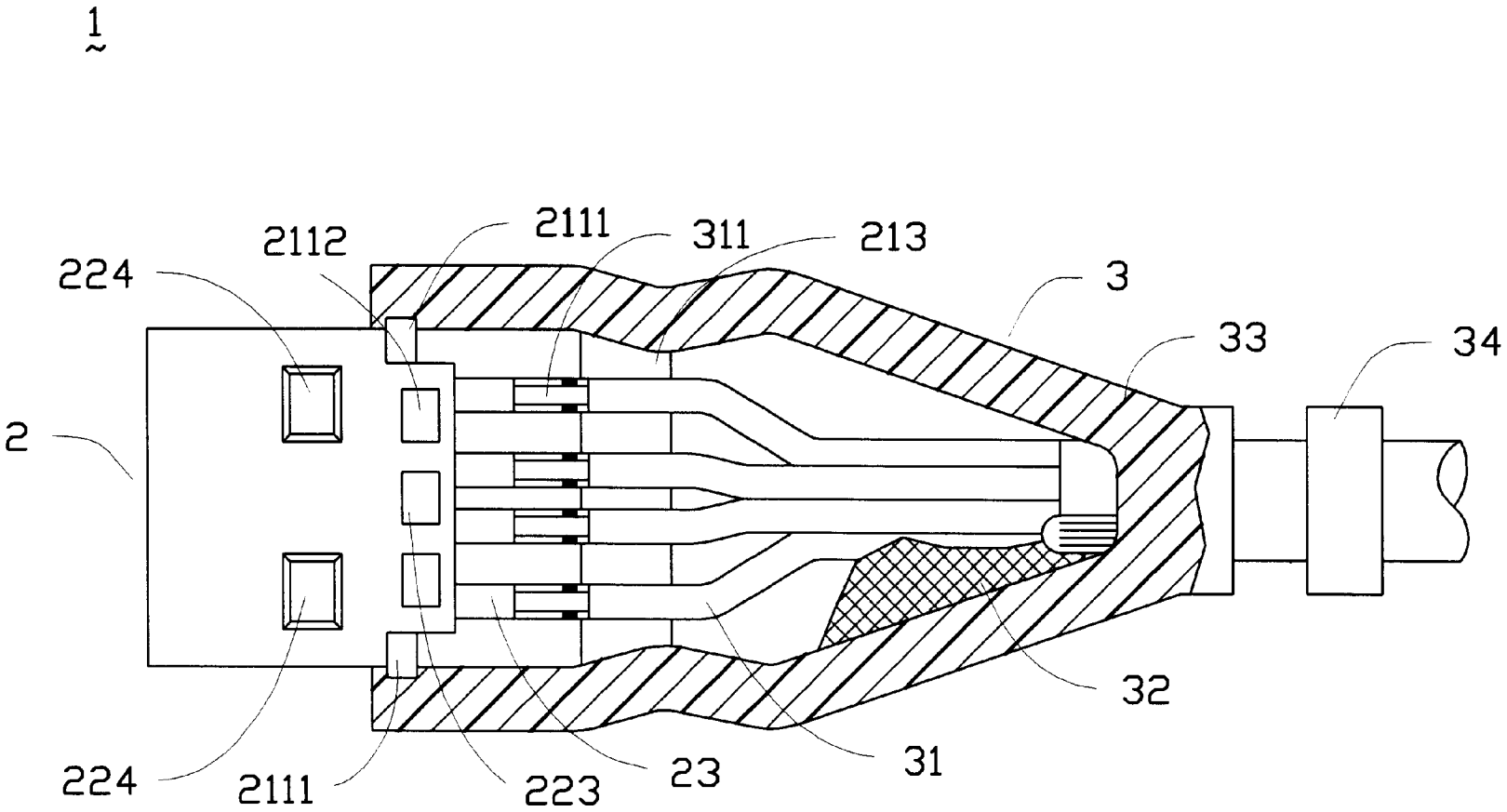
FIG. 5 is a cross sectional view of the cable connector assembly shown in FIG. 1 taken from line V—V.

Referring now to FIG. 4, in manufacturing, the metal shell 22 may be stamped and formed on a metal strip as a unitary piece connecting to a carrier of the strip, and then cut off from the carrier at a rear portion connecting to the carrier, which is illustrated in FIG. 4 by a dashed line. The metal shell 22 is substantially formed as a frame having a top wall, a bottom wall and two lateral walls. These walls define a through cavity therebetween for receiving the insulating housing 21. The metal shell 22 further comprises a pair of beam extensions 221 having an L-shaped cross section and extending rearward from either bottom corner thereof for protecting the insulating housing and increasing the strength of the cable connector assembly. The metal shell 22 may further comprise a pair of inward bulge 222 on either lateral wall thereof for interference fit with inner lateral surfaces of the insulating housing 21 to enhance the connecting strength therebetween when the insulating housing 21 is inserted in the metal shell 22. Moreover, the metal shell 22 may further comprise a pair of openings 223 on each of the top and the bottom walls thereof for securely receiving the protrusions 2112 of the main body 211. Furthermore, the metal shell 22 may comprise a pair of indents 224 on the top wall of the metal shell 22 for positioning a mating USB connector (not shown) when the cable connector assembly 1 is coupled to a mating receptacle connector. The Referring now to FIGS. 2 and 5, while assembling, the conductive contacts 23 are inserted into the passageways 214 of the insulating housing 21. One end of the conductive contact 23 extends out of the passageway 214 into the engaging portion 212 for engaging with a contact of a mating receptacle connector (not shown). The other end of the conductive contact 23 extends out of the passageway 214 into the supporting portion 213 for connecting to a conductor 311 of a wire 311 of the cable end section 3 composing of a number of wires 311. The insulating housing 21 with the contacts 23 inserted therein is then inserted into the through cavity of the metal shell 22 until the blocks 2111 of the insulating housing 21 are stopped by edges of the metal shell 22. The insulting housing 21 is firmly fixed to the metal shell 22 by means of the bulges 222, the protrusions 2112, and the openings 223 of the metal shell 22, as mentioned previously. Next, the conductive contacts 23 are connected to the conductors 311 by soldering or other known methods. A resin material, for example, an epoxy resin, is then applied onto a front portion of the cable end section 3 and a rear portion of the plug section 2 to provide a further fixing effect. In one preferred embodiment, the resin material may be applied over the supporting portion 213 and the wires 31 adjacent to the supporting portion 213. A copper foil 32 may be wrapped over the resin material for preventing electron-magnetic interference and for grounding. Finally, a jacket 33 may be molded over a rear portion of the plug section 2 and a front portion of the cable portion 3 for providing a strong structure to the cable connection assembly. In one preferred embodiment, the blocks 2111, the protrusions 2112, the openings 223, and the copper foil 32 and/or the resin layer are all covered by the molded jacket 33, leaving the indents 224 exposed for connecting to a mating receptacle connector. In addition, a number of collars 34 can be provided on the cable adjacent to the jacket 33 to further increase the strength of the mechanical connection of the cable end section to the plug section.

By way of a series of fastening and protection means mentioned above, firmly mechanical connection and effective electrical connection between the plug section and the cable section can be ensured, even under situations in which large external forces exert on the present cable connector assembly.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

It is claimed that:

1. A cable connector assembly, comprising:

a plug section including an insulating housing having a plurality of passageways formed therethrough and a pair of blocks formed on opposite side walls thereof, a plurality of conductive contacts received in said plurality of passageways, and a metal shell retained around the insulating housing and having a pair of rearward extending beam portions extending past and beside the pair of blocks; and a cable end section electrically connected to said plurality of conductive contacts.

2. The cable connector assembly as claimed in claim 1, wherein said metal shell is of a single piece and comprises four walls and each said beam portion is an L-shaped beam extension extending rearward from two corners defined respectively by two adjacent walls of the metal shell.

3. The cable connector assembly as claimed in claim 1, wherein at least one inward bulge is provided on a surface of the metal shell in interference fit with the insulation housing.

4. The cable connector assembly as claimed in claim 1, wherein each block positions the metal shell with respect to the insulating housing.

5. A metal shell for use within a cable connector assembly which includes an insulating housing comprising a main body, a pair of blocks formed on the main body, an engaging portion extending forward from the main body and a supporting portion extending rearward from the main body, said metal shell comprising:

a top wall, a bottom wall and two lateral walls commonly defining a through cavity for receiving the engaging portion and the main body of the insulating housing therein; and a pair of L-shaped beam extensions extending rearward from two bottom corners of the bottom wall and the corresponding lateral walls, for extending past and beside the pair of blocks, for supportable and protective engagement with the supporting portion of the housing.

6. The metal shell as claimed in claim 5, further comprising a pair of inward bulges on a surface thereof for interference fit with the insulating housing.

* * * * *